US010757990B2

(12) United States Patent
Davis et al.

(10) Patent No.: US 10,757,990 B2
(45) Date of Patent: Sep. 1, 2020

(54) CLOTHING ACCESSORY

(71) Applicant: Namakan Fur, LLC, St. Paul, MN (US)

(72) Inventors: Margaret Grace Davis, St. Paul, MN (US); Molly Marie Mogren Katt, Minneapolis, MN (US); Elizabeth Doyle Skophammer, Minneapolis, MN (US)

(73) Assignee: Namakan Fur, LLC, St Paul, MN (US)

( * ) Notice: Subject to any disclaimer, the term of this patent is extended or adjusted under 35 U.S.C. 154(b) by 0 days.

(21) Appl. No.: 16/120,828

(22) Filed: Sep. 4, 2018

(65) Prior Publication Data

US 2019/0069620 A1 Mar. 7, 2019

Related U.S. Application Data

(60) Provisional application No. 62/553,576, filed on Sep. 1, 2017.

(51) Int. Cl.

| | |
|---|---|
| ***A41D 27/08*** | (2006.01) |
| ***A43B 23/24*** | (2006.01) |
| ***A41D 5/00*** | (2006.01) |
| ***A41D 3/00*** | (2006.01) |
| ***A41F 1/00*** | (2006.01) |

(Continued)

(52) U.S. Cl.

CPC ..... *A41D 27/08* (2013.01); *A41D 3/00* (2013.01); *A41D 5/003* (2013.01); *A41F 1/002* (2013.01); *A43B 1/0054* (2013.01); *A43B 3/0078* (2013.01); *A43B 23/24* (2013.01);

(Continued)

(58) Field of Classification Search

CPC ..... A45C 3/08; A45C 13/08; A45C 13/001; A41D 27/08; A41D 23/00; A41D 15/005; A41D 5/00; A41D 3/00; A41D 5/003; A41D 15/00; A41D 2200/20; A41D 15/04; A41D 2023/004; A41D 20/00; A41D 27/18; A42B 1/048; A41F 1/002; A41F 15/002; A41F 1/00; A44C 17/0208; A44C 25/00; A43B 3/0078; A43B 23/24; A43B 1/0054; A44B 11/001; A44B 1/04; A43C 11/24

See application file for complete search history.

(56) References Cited

U.S. PATENT DOCUMENTS 1,525,322 A * 2/1925 Post ..... A42B 1/045 2/84
2,290,638 A * 7/1942 Englander ..... A41D 15/002 2/70

(Continued)

FOREIGN PATENT DOCUMENTS

| | | | |
|---|---|---|---|
| CA | 2875860 | A1 | 6/2016 |
| DE | 102012107133 | A1 | 2/2014 |
| DE | 202015009314 | U1 | 3/2017 |

*Primary Examiner* — Robert H Muromoto, Jr.
(74) *Attorney, Agent, or Firm* — Merchant & Gould P.C.

(57) ABSTRACT

A clothing accessory includes a flat envelope formed from at least two pieces of fabric mated to form the envelope. The envelope defines a generally rectangular shape with a first long edge and an opposing second long edge. The envelope also defines a first short edge and an opposing second short edge. The clothing accessory includes a plurality of attachment structures that are provided adjacent each of the opposing first and second long edges within the envelope.

14 Claims, 8 Drawing Sheets

(51) Int. Cl.

| | |
|---|---|
| ***A43B 1/00*** | (2006.01) |
| ***A43B 3/00*** | (2006.01) |
| *A41D 27/00* | (2006.01) |
| *A41D 27/14* | (2006.01) |

(52) U.S. Cl.

CPC ..... *A41D 27/14* (2013.01); *A41D 2200/20* (2013.01); *A41D 2300/30* (2013.01)

(56) References Cited

U.S. PATENT DOCUMENTS

D155,811 S * 11/1949 Kigere ..... D3/233
2,510,720 A * 6/1950 Siegel ..... A41D 23/00 2/91
2,834,966 A * 5/1958 Zimmerman ..... A41D 27/18 2/84
3,466,663 A * 9/1969 Mehl ..... A41D 27/08 2/65
3,646,614 A * 3/1972 Engelmann ..... A41D 23/00 2/91
3,846,844 A * 11/1974 Graf ..... A41D 5/00 2/93
4,347,629 A 9/1982 Itoi
5,029,344 A * 7/1991 Shannon ..... A41D 15/005 2/115
5,172,428 A * 12/1992 Leinoff ..... A41D 5/00 2/181
5,230,100 A * 7/1993 Lock-Jones ..... A45D 44/08 2/174
5,533,558 A * 7/1996 Carey ..... A45C 3/08 150/105
5,542,157 A * 8/1996 Herman ..... A44B 1/04 24/113 MP
5,718,000 A 2/1998 Ost et al.
5,873,132 A 2/1999 Grilliot et al.
6,047,404 A * 4/2000 Blanks, I ..... A41D 15/00 2/108
6,129,126 A * 10/2000 Restivo ..... A45C 3/08 150/104
6,173,837 B1 * 1/2001 Marconi ..... A45C 3/08 190/125
6,256,793 B1 * 7/2001 Arias ..... A41D 23/00 2/207
6,263,509 B1 7/2001 Bowen
6,499,141 B1 * 12/2002 Egnew ..... A41D 13/00 2/108
6,519,778 B2 * 2/2003 Arias ..... A41D 23/00 2/207
6,820,664 B1 * 11/2004 Ritch ..... A45C 3/08 150/103
6,848,118 B2 * 2/2005 Barnes ..... A41D 3/005 2/108
7,028,730 B2 * 4/2006 Pace ..... A45C 3/08 150/103
7,058,981 B2 6/2006 Clark et al.
7,222,649 B1 * 5/2007 Fox ..... A45C 3/08 150/104
7,461,676 B2 * 12/2008 Huie ..... A45C 3/08 150/105
7,607,461 B2 * 10/2009 Pace ..... A45C 13/02 150/103
7,789,114 B2 * 9/2010 Pace ..... A45C 3/08 150/103
7,819,721 B1 * 10/2010 Messier ..... A41D 27/08 2/244
8,069,538 B2 * 12/2011 Wilcox ..... A43B 3/0078 119/858
8,156,974 B2 * 4/2012 Pace ..... A45C 3/08 150/103
8,272,072 B1 * 9/2012 Fowler ..... A41D 15/00 2/263
8,425,072 B2 * 4/2013 Hurwitz ..... A41D 27/08 362/103
8,919,354 B2 * 12/2014 Davis ..... A45D 8/36 132/275
9,403,044 B2 * 8/2016 Pirone ..... F41H 3/02
9,622,559 B2 * 4/2017 Pace ..... A45C 3/001
10,143,251 B2 * 12/2018 Kiker ..... A41D 27/08
10,156,247 B2 * 12/2018 Pensak ..... A41F 1/002
2002/0023289 A1 * 2/2002 Arias ..... A41D 23/00 2/279
2003/0177664 A1 * 9/2003 Monassebian ..... A43B 1/0027 36/100
2006/0118219 A1 * 6/2006 Hong ..... A45C 3/06 150/129
2007/0083971 A1 * 4/2007 Scully ..... A41D 15/002 2/69
2007/0266476 A1 * 11/2007 Ulrich ..... A42B 1/045 2/202
2007/0289681 A1 * 12/2007 Bond ..... A45C 13/08 150/104
2009/0068920 A1 * 3/2009 Brielmann ..... A63H 3/02 446/73
2009/0068922 A1 * 3/2009 Brielmann ..... A63H 3/02 446/268
2010/0011626 A1 * 1/2010 Ali ..... A41F 17/00 36/70 R
2010/0218297 A1 * 9/2010 Harada ..... A41D 1/04 2/65
2010/0277944 A1 * 11/2010 Hurwitz ..... A41D 27/08 362/570
2011/0247201 A1 * 10/2011 d'Auriac ..... A41D 27/08 29/700
2011/0253273 A1 * 10/2011 Kay ..... A45C 3/08 150/104
2012/0131722 A1 5/2012 Kang
2012/0214013 A1 * 8/2012 Namsaraeva ..... A41D 27/08 428/542.2
2013/0108884 A1 * 5/2013 Lillich ..... A44C 25/00 428/542.2
2013/0291886 A1 * 11/2013 Davis ..... A45D 8/36 132/275
2014/0026375 A1 * 1/2014 Gibby ..... A45C 13/1069 24/303
2014/0338093 A1 * 11/2014 Gersten ..... A42B 1/048 2/84
2015/0327612 A1 * 11/2015 Bublitz ..... A41D 3/02 2/202
2016/0095359 A1 * 4/2016 Fox ..... A41D 3/005 2/84
2016/0157576 A1 * 6/2016 Beck ..... A45D 8/26 132/275
2017/0273376 A1 * 9/2017 Fudem ..... A41D 5/00
2018/0070656 A1 * 3/2018 Morency ..... A41D 13/1245

* cited by examiner

CLOTHING ACCESSORY

RELATED APPLICATION

This application claims priority to U.S. Provisional Patent Application Ser. No. 62/553,576, filed on Sep. 1, 2017, the entirety of which is incorporated by reference herein.

BACKGROUND

Clothing garments are meant to provide utility to the wearer and provide the wearer an opportunity to make a fashion statement. Clothing accessories can be worn and used with clothing garments to change the look of the outfit. Such accessories can include scarves, hats, shawls, etc. However, most standalone accessories are designed to be worn in addition to the clothing garment. The wearer is still then left with the same clothing garment, no matter what accessory is paired with it. If the wearer would like to modify the actual clothing garment to achieve a different look, such modifying can be a time intensive job that requires a skilled hand. The same goes for modifying an accessory. Modifying clothing garments and accessories often requires permanent alterations to the item that are irreversible.

Therefore, improvements in attachable and removable clothing accessories application are desired.

SUMMARY

One aspect of the present disclosure relates to a removable clothing accessory. In one possible configuration, and by a non-limiting example, a foldable clothing accessory that has a plurality of attachment structures and is configured to be removably attached to an edge of a clothing garment is disclosed.

In one aspect of the present disclosure, a clothing accessory is disclosed. The clothing accessory includes a flat envelope formed from at least two pieces of fabric mated to form the envelope. The envelope defines a generally rectangular shape with a first long edge and an opposing second long edge. The envelope also defines a first short edge and an opposing second short edge. According to one example embodiment, the clothing accessory includes a plurality of attachment structures that are provided adjacent to each of the opposing first and second long edges within the envelope.

In another exemplary aspect of the present disclosure, a method of attaching a clothing accessory is disclosed. The method includes providing a rectangular clothing accessory that includes a first long edge and an opposing second long edge. The clothing accessory also includes a first short edge and an opposing second short edge. The clothing accessory includes a plurality of attachment structures that are provided adjacent to each of the opposing first and second long edges within a rectangular envelope. The clothing accessory is foldable along a folding line that longitudinally bisects the rectangular envelope. The method includes positioning the first long edge of the clothing accessory adjacent to a first side of a clothing edge. The method includes folding the clothing accessory over the clothing edge about the folding line of the clothing accessory. The method includes positioning the second long edge of the clothing accessory adjacent to a second side of a clothing edge. The method also includes mating the attachment structures positioned at the first long edge with the attachment structures positioned at the second long edge through the clothing.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
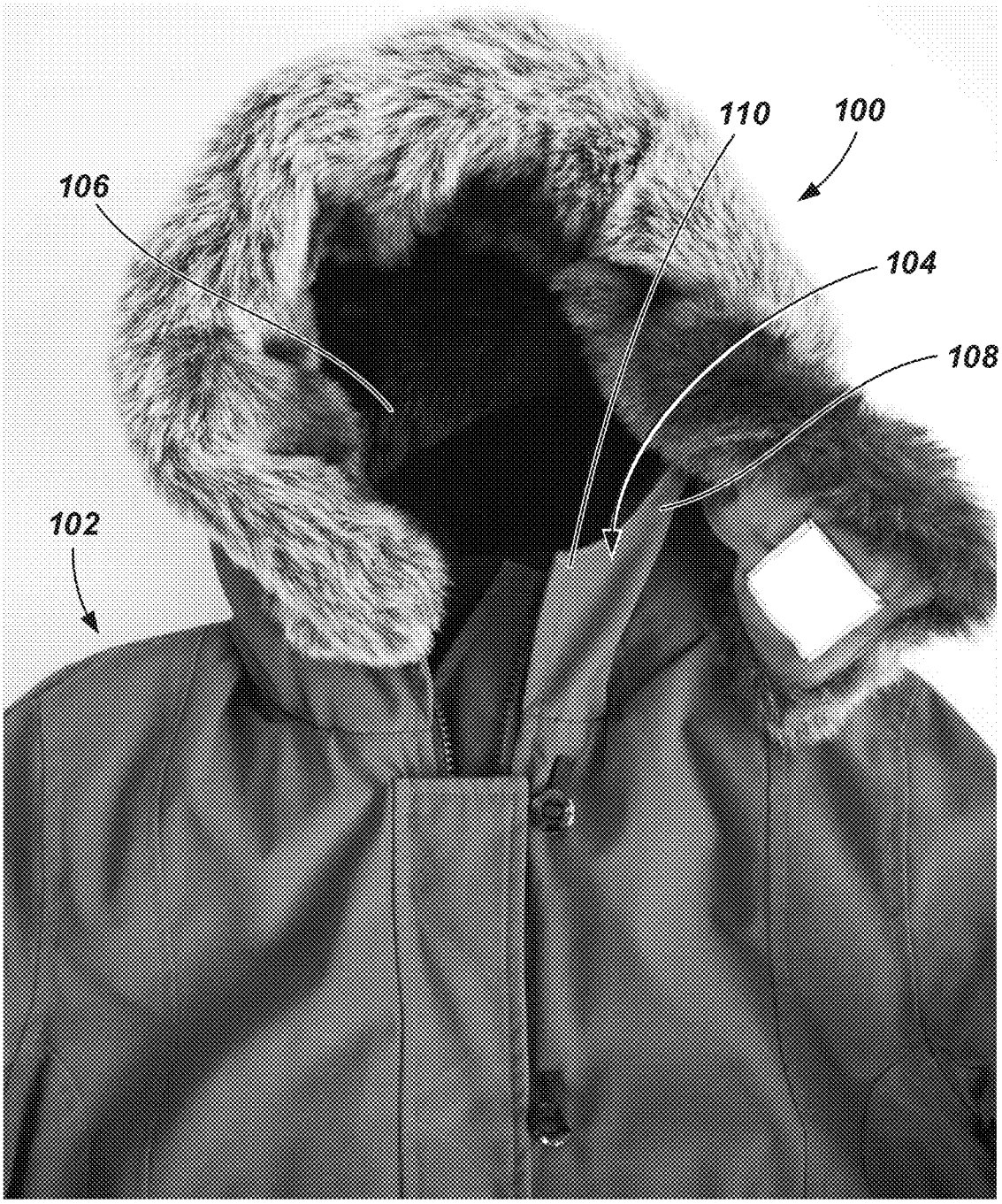
FIG. 1 is a schematic front view of a clothing garment and a clothing accessory, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The clothing accessory disclosed herein has many advantages. The clothing accessory is configured to be removably attached to a clothing garment to change the look and/or function of the clothing garment. The clothing accessory 100 is provided as a stand-alone, self-attaching structure that does not need mating attachment mechanisms on the clothing garment. The clothing accessory is easy to store as a flat, rectangular envelope, defined by the clothing accessory of the present disclosure, it can simply be rolled up and tucked away when not in use. Further, the clothing accessory can conform to different curved or straight edges.

FIGS. 1-8 illustrate a clothing accessory 100 having features that are examples of inventive aspects in accordance with the present disclosure. In the illustrated example, the clothing accessory 100 is shown as a ruff that can be removably attached to a piece of outerwear such as a coat or a jacket.

FIG. 1 shows the clothing accessory 100 removably attached to a conventional clothing garment 102. In some examples, the clothing accessory 100 can be positioned around an edge 104 defined by part of the clothing garment 102. Specifically, the clothing accessory 100 can be positioned adjacent a first, inner side 106 of the edge 104 and a second, outer side 108 of the edge 104 and folded around the edge 104. Once folded around the edge 104, the clothing accessory 100 is configured to attach to the clothing garment 102 to allow a user to modify the appearance and/or utility of the clothing garment 102 without permanently altering the clothing garment 102, as will be discussed in further detail below.

The clothing accessory 100 is configured to be positioned on a variety of different types of clothing and clothing accessories such as shirts, jackets, hoods, pants, hats, gloves, scarves, boots, etc. Further, the edge 104 shown and described herein is an example and is meant to be illustrative that the clothing accessory 100 can be attached to any edge of a variety of different types of clothing garments 102.

Figure 2:
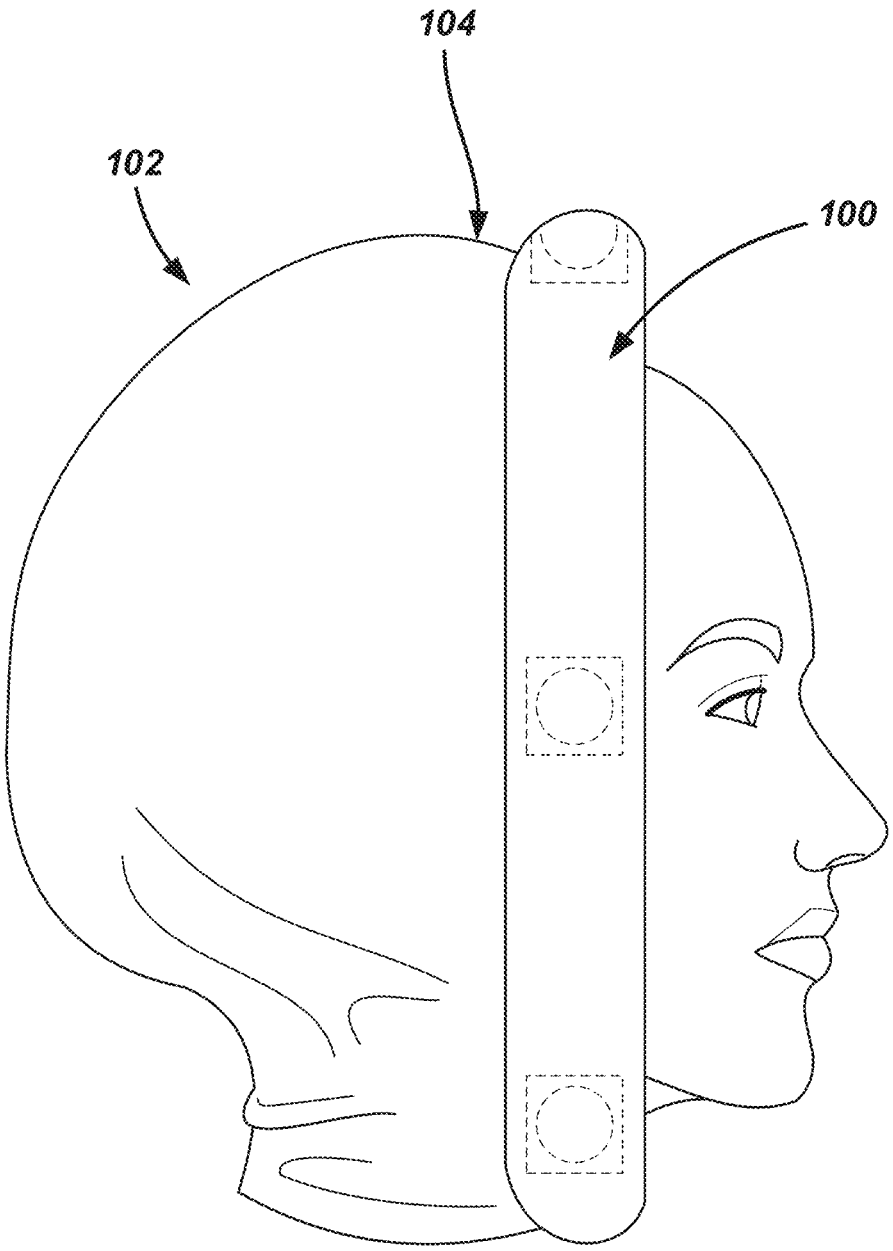
FIG. 2 is a schematic side view of the clothing garment and clothing accessory of FIG. 1.

FIG. 2 shows a side view of a clothing garment 102 with the clothing accessory 100 attached thereto. In the depicted example, the clothing garment 102 is a hood and the edge 104 is defined by the edge of the hood.

Figure 3:
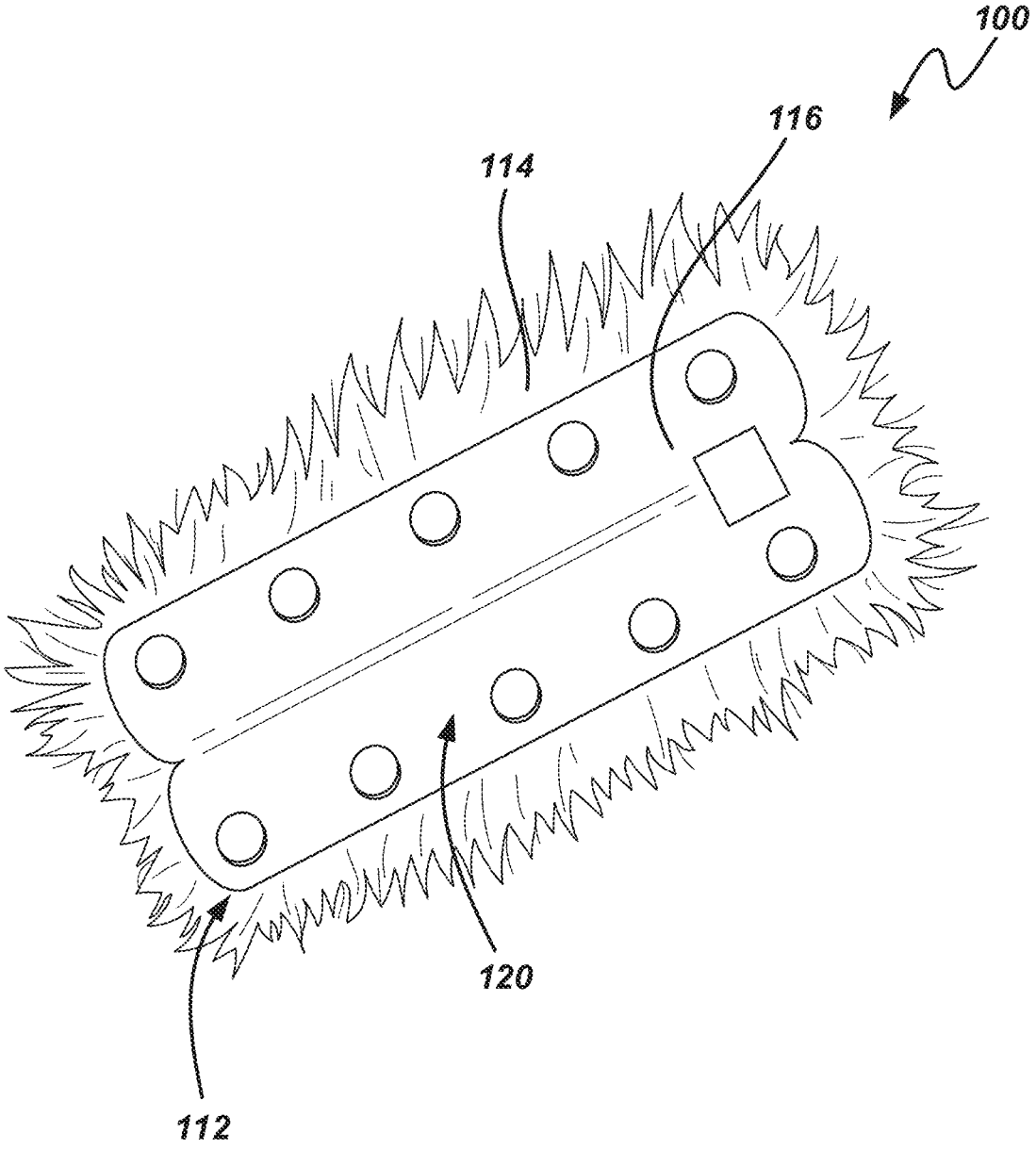
FIG. 3 is a perspective view of the clothing accessory of FIG. 1.

FIG. 3 shows a schematic view of the clothing accessory 100. In the depicted example, when the clothing accessory 100 is not attached to a clothing garment 102, the clothing accessory 100 is generally planar in shape defining a flat envelope 112 formed from at least two pieces of fabric 114, 116 mated to form the envelope 112. In some examples, a first piece of fabric 114 forms an outer side 118 and a second piece of fabric 116 forms an inner side 120 of the clothing accessory 100.

As shown in FIGS. 1-8, the first piece 114 of the two planar pieces of fabric may be a textured fabric or include surface texturing, wherein the texturing may resemble fur (faux fur) or a similar material. In this manner, as will be described in further detail below, the clothing accessory 100 can be worn as a faux fur ruff on various parts of a piece of outerwear.

The second piece 116 of the two planar pieces of fabric can be a piece of fabric that is configured to interface with the clothing garment 102. In some examples, the second piece of fabric 116 may include a decorative pattern. And, in other examples, the second piece 116 is different from the first piece 114. In some examples, the second piece 116 is substantially similar to the first piece 114.

Figure 4:
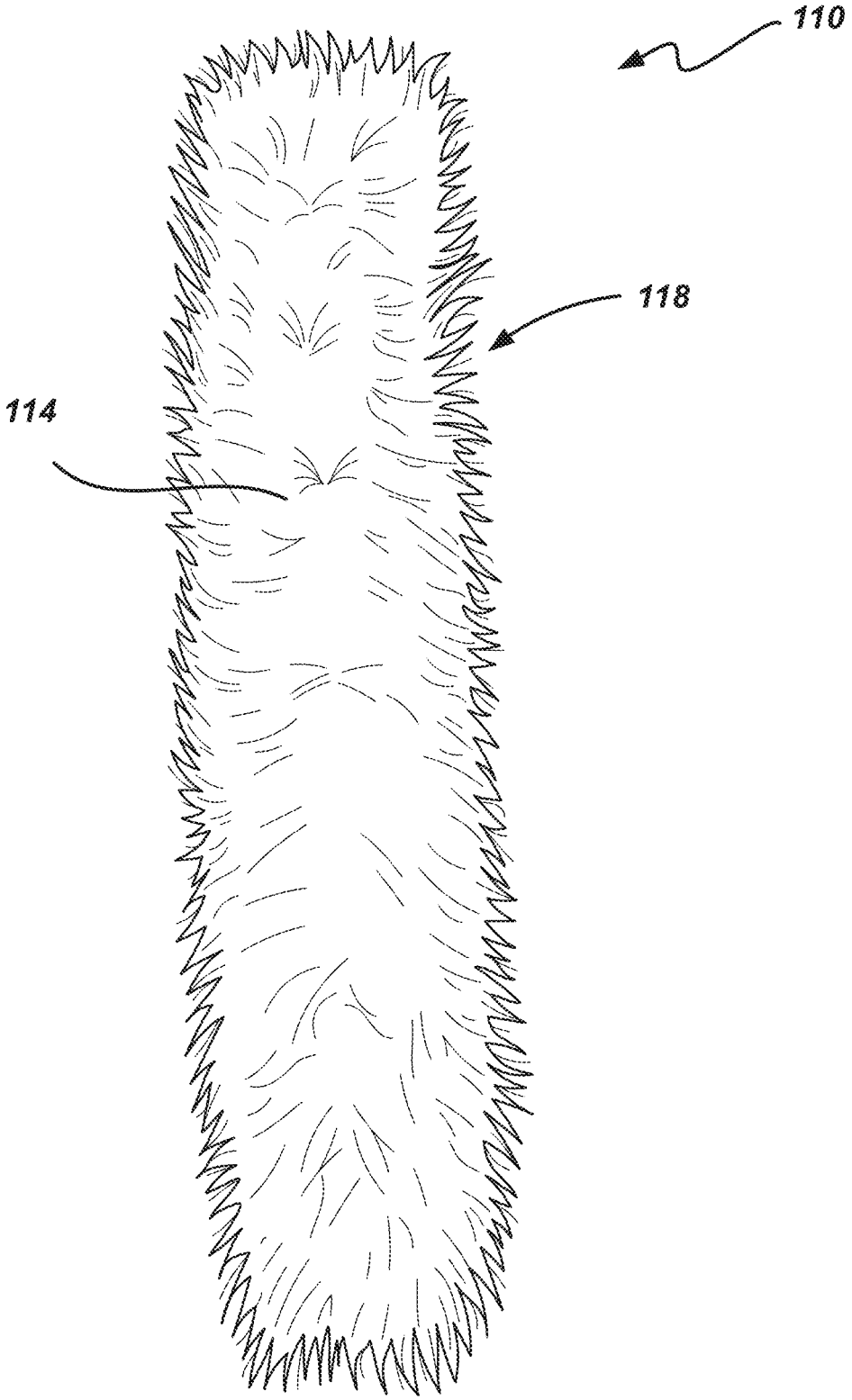
FIG. 4 is an outer or top view of the clothing accessory of FIG. 1.

FIG. 4 shows the outer side 118 of the clothing accessory 100. In the depicted embodiment, the first piece of fabric 114 is sized so that the second piece of fabric 116 is not visible from the outer side 118 of the clothing accessory 100.

Figure 5:
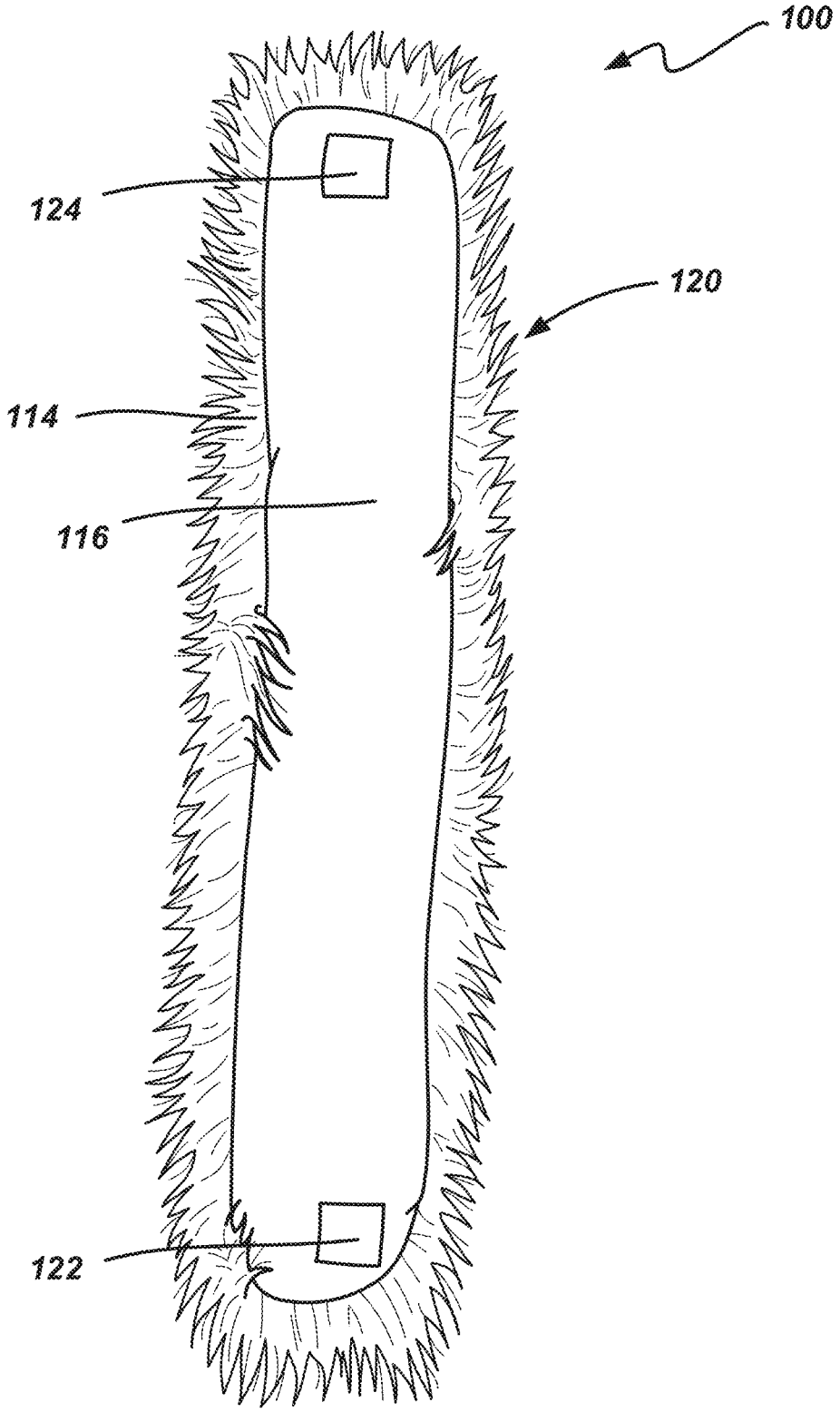
FIG. 5 is an inner or bottom view of the clothing accessory of FIG. 1.

FIG. 5 shows the inner side 120 of the clothing accessory 100. In the depicted embodiment, the first piece of fabric 114 is sized as such that it completely surrounds the second piece of fabric 116. In some examples, the inner side 120 can include decorative labels 122 and/or removable cleaning instructions 124.

Figure 6:
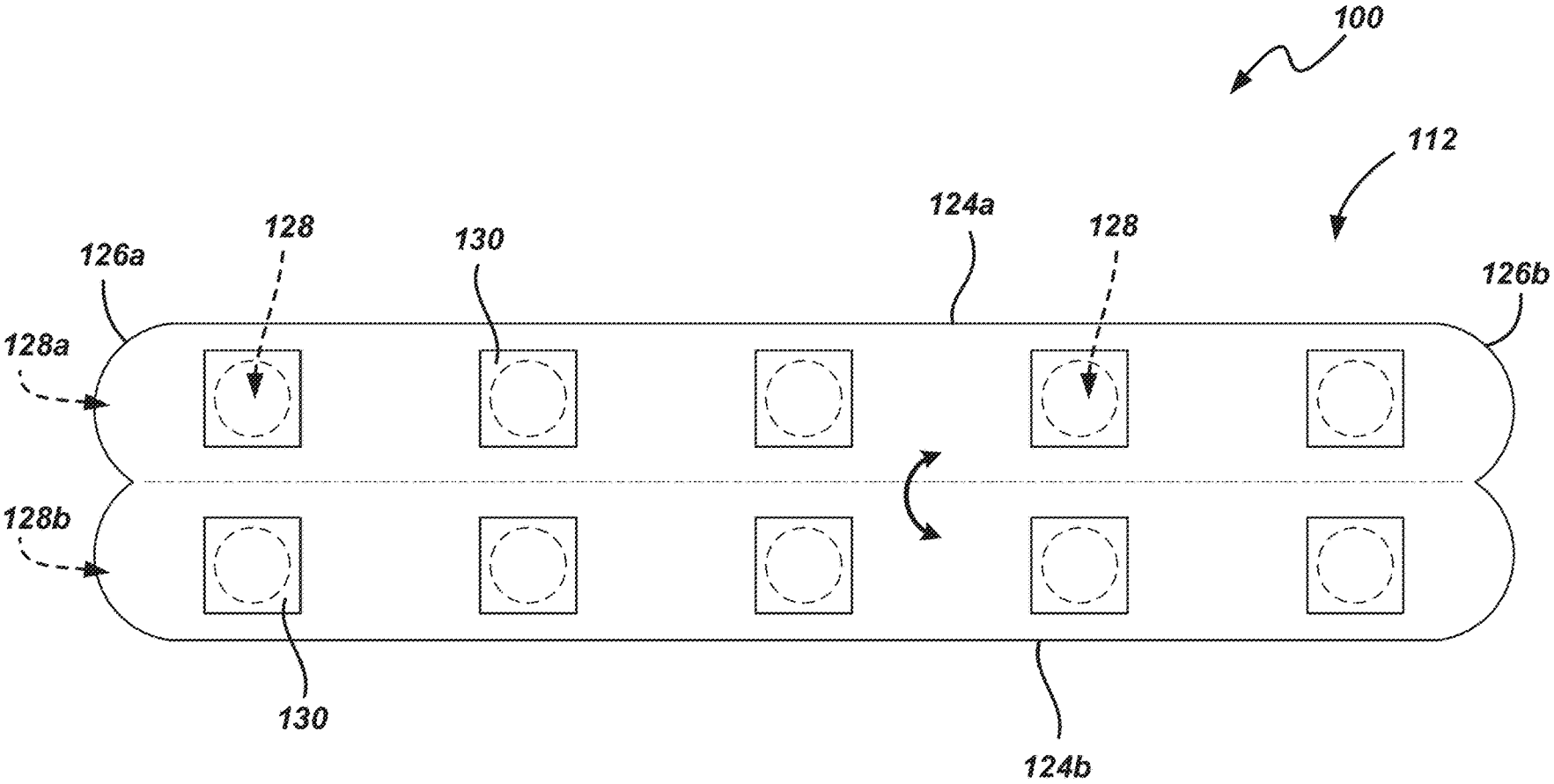
FIG. 6 is schematic view of the clothing accessory of FIG. 1 schematically illustrating the attachment structures.

FIG. 6 schematically shows the envelope 112 defined by the clothing accessory. The envelope 112 formed by the clothing accessory 100 defines a generally rectangular shape with two opposing long edges 124*a*, 124*b* and two opposing shorter edges 126*a*, 126*b*. Provided adjacent to each of the opposing long edges 124*a*, 124*b* (first 124*a* and second 124*b* long edges), within the envelope 112, are a plurality of attachment structures 128. According to one example embodiment, the attachment structures 128 are magnets and/or structures including magnetic properties. Thus, along the first long edge 124*a* of the clothing accessory 100 are provided a first plurality of attachment structures 128*a* and along the second long edge 124*b* of the clothing accessory 100 are provided a second plurality of attachment structures 128*b*.

In some examples, the attachment structures 128 are neodymium magnets. In some examples, the attachment structures 128 are neodymium magnets having a grade N38 and nickel coated. In other examples, each attachment structure 128 is contained within a pouch 130, such as a plastic pouch. In some examples, the attachment structures 128 each have a pull force between about 5 pounds and 10 pounds. In other examples, the attachment structures 128 each have a pull force of about 7 pounds. In some examples, the attachment structures 128 each have an operating temperature between about 160 degrees Fahrenheit and 190 degrees Fahrenheit. In some examples, the attachment structures 128 each have an operating temperature of about 176 degrees Fahrenheit. In some examples, each attachment structure 128 has a Brmax (i.e., residual induction) of about 12,600 Gauss and a BHmax (i.e., maximum energy product) of about 38 MGOe.

The attachment structures 128 of the clothing accessory 100 are configured such that the first plurality of attachment structures 128*a* along the first long edge 124*a* are attracted (e.g., magnetically attracted) to the second plurality of attachment structures 128*b* along the second edge 124*b*. In this manner, when the clothing accessory 100 is folded along a line L that longitudinally bisects the rectangular envelope 112 and the first long edge 124*a* is brought toward the second long edge 124*b*, the first plurality of attachment structures 128*a* are coupled (e.g., via a magnetic force) with the second plurality of attachment structures 128*b*. As such, the attachment structures 128 can capture an edge (e.g., the edge 104) of the clothing garment 102 thereinbetween and provide a mechanism for removably mounting the clothing accessory 100 to that clothing garment 102. Different types, shapes, and sizes of attachment structures 128 can be used as long as the attachment structures 128 used within the envelope 112 are strong enough to provide a clamping effect with the edge 104 of the clothing garment 102 captured thereinbetween.

In some examples, the attachment structures 128 are attached to at least one piece of fabric 114, 116 of the envelope 112. In some examples, the attachment structures 128 are positioned within the envelope 112. It is also contemplated that the attachment structures 128 can be attached to an exterior of the fabric 114, 116. In some examples, the attachment structures 128 are attached to an interlining piece of fabric (shown in FIG. 7) captured between the first and second pieces of fabric 114, 116. The attachment structures 128 can be attached to the envelope 112 in a variety of different ways such as by sewing or adhering. In some examples, each pouch 130 of each attachment structure 128 is attached to the envelope 112. In some examples, the attachment structures 128 are not normally visible when the clothing accessory 100 is in use. However, an envelope design with hidden attachment structures 128 provides a sleeker look to the clothing accessory 100 and also limits the risk of damaging or losing one or more attachment structures 128 during everyday use.

The two opposing long edges 124*a*, 124*b* and the two opposing shorter edges 126*a*, 126*b* can have a variety of different profiles. In the depicted example, the shorter edges 126*a*, 126*b* have a rounded profile so that when the clothing accessory 100 is folded in half along line L, the shorter edges 126*a*, 126*b* come together to form a half circle.

Although the clothing accessory 100 has been depicted and described as having a generally rectangular profile, it should be noted that other shapes can be used. As long as the provided shape defines two opposing edges with a sufficient number of attachment structures 128 provided along each edge for the clamping function, shapes other than a rectangular profile are possible.

According to certain embodiments, the clothing accessory 100 can be folded along line L and attached to an edge 104 defined by the edge of a hood of a coat or a jacket via the attachment structures 128. According to other embodiments still, the clothing accessory 100 can be folded and attached around the top portion of a boot. It is also contemplated that the clothing accessory 100 may be attached to other portions of a piece of outerwear. For example, the clothing accessory 100 may be attached to the edges defined by the ends of the sleeves of a coat or a jacket. The envelope 112 gives the clothing accessory 100 the flexibility to conform to different edges provided on the clothing garment 102.

Figure 7:
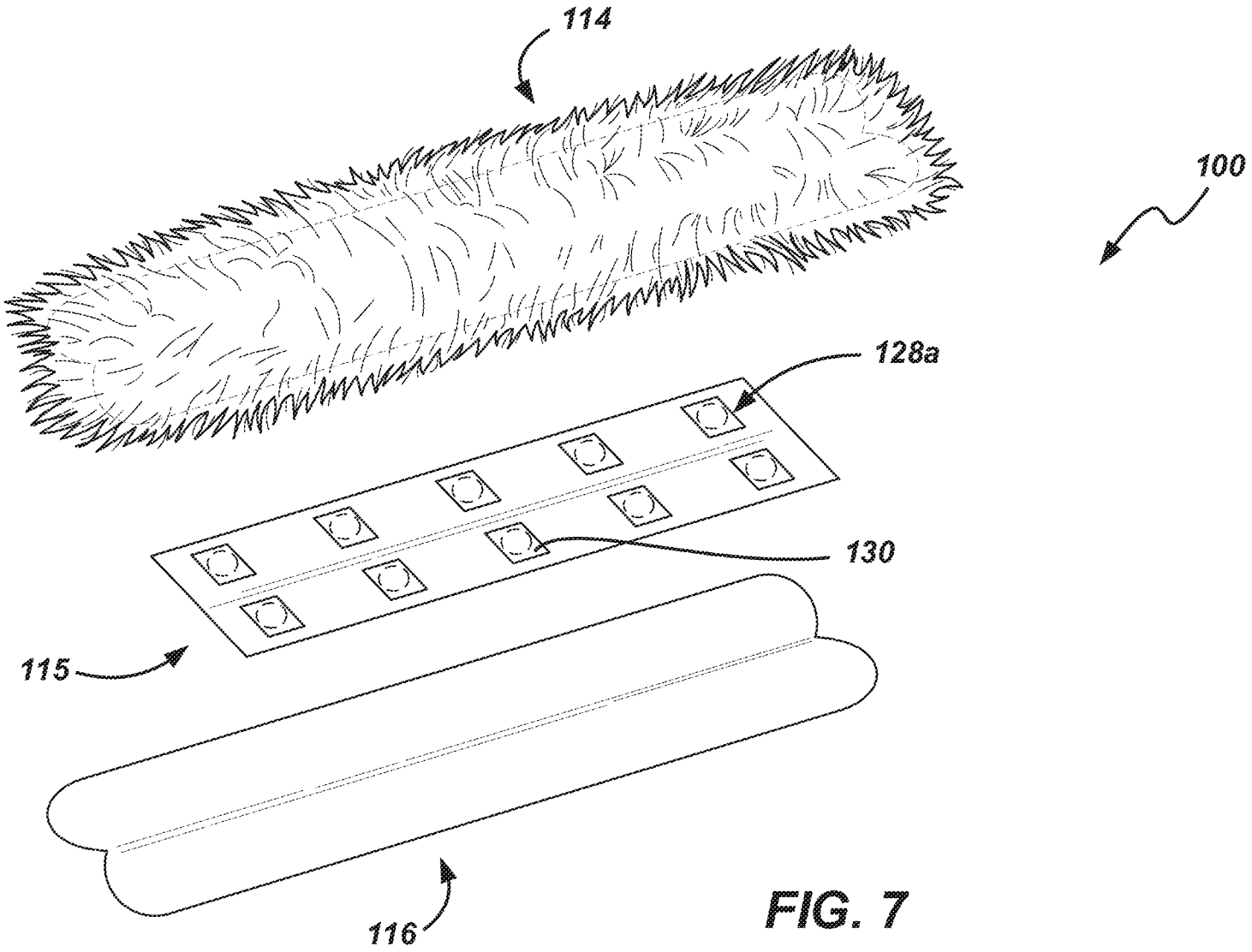
FIG. 7 is a schematic exploded view of the clothing accessory of FIG. 1 illustrating the components that make up the clothing accessory.

FIG. 7 shows a perspective exploded view of the clothing accessory 100, according to one embodiment of the present disclosure. As shown, the clothing accessory includes the first piece of fabric 114, the second piece of fabric 116, and an interlining 115 positioned between the first and second pieces of fabric 114, 116.

The interlining 115 can be attached to the plurality of attachment structures 128 and positioned between the first and second pieces 114, 116. In some examples, the interlining 115 has less surface area than at least one of the first and second pieces 114, 116 of fabric. In some examples, the interlining 115 is formed from a different material than the material used to form the first and second pieces 114, 116.

In some examples, each pouch 130 of each attachment structure 128 is attached to the interlining 115 first during the manufacturing process. The first and second pieces 114, 116 are then positioned around the interlining 115 and attached to one another such that the interlining is captured therebetween. In some examples, the interlining 115 is attached to both the first and second pieces 114, 116.

Figure 8:
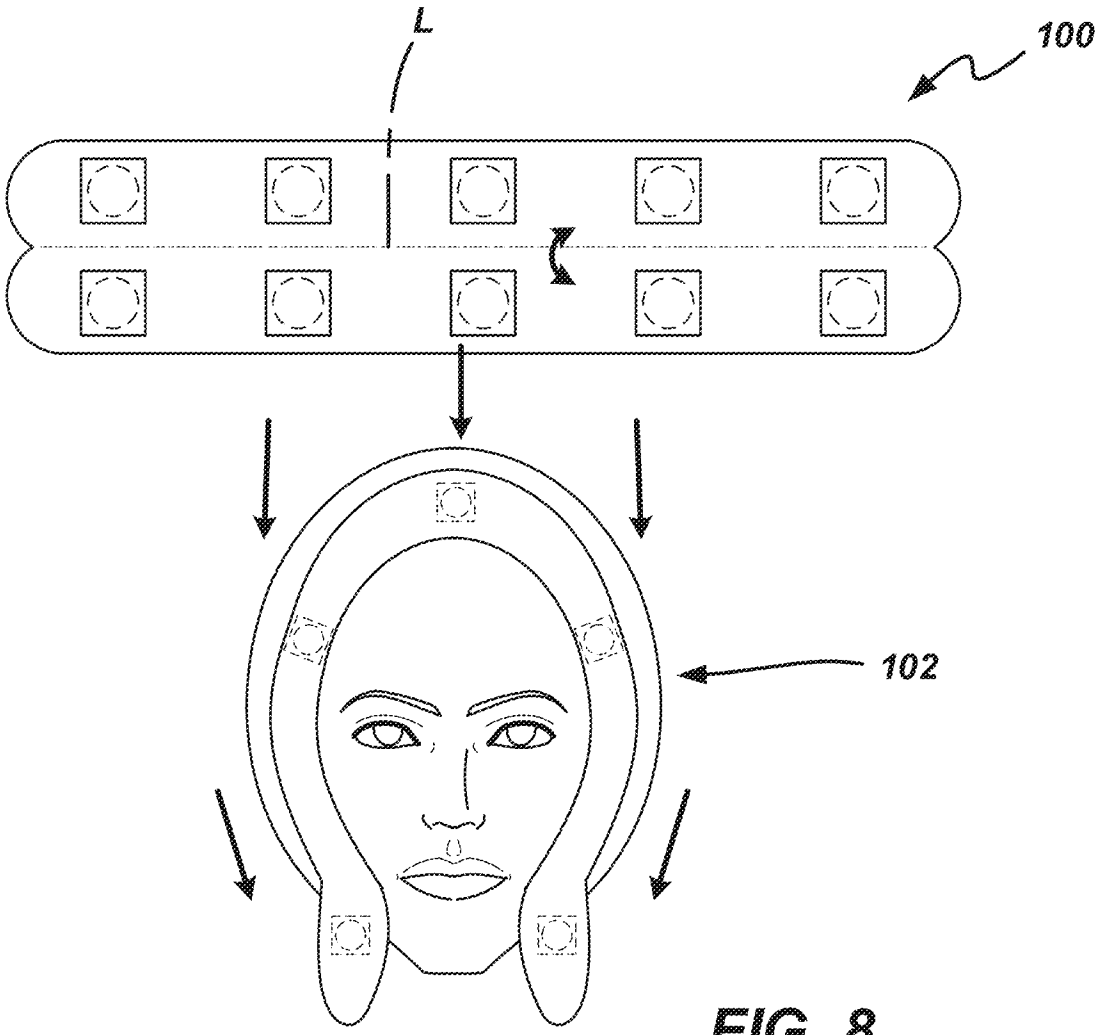
FIG. 8 is a schematic view illustrating a method of installing the clothing accessory of FIG. 1 onto a clothing garment.

FIG. 8 shows a method of installing the clothing accessory 100 to a clothing garment 102. To install the clothing accessory 100, the first long edge 124*a* is positioned adjacent a first side (either the inner side 106 or outer side 108) defining the clothing edge 104. In the depicted example, the edge 104 is a hood edge. The clothing accessory 100 is then folded along line L over the edge 104. The second long edge 124*b* is then positioned adjacent a second side (either the inner side 106 or outer side 108), opposite the first side, defining the clothing edge 104. The attachment structures 128*a*, 128*b* of the first and second sides 124*a*, 124*b* are then mated to clamp the edge 104 of the clothing garment 102 therebetween. The same method can be repeated when using a variety of different clothing garments 102 such as, but not limited to, shirts, jackets, hoods, pants, hats, gloves, scarves, boots, etc.

The above specification, examples and data provide a complete description of the manufacture and use of the composition of the inventive aspects of the disclosure. Since many embodiments of the inventive aspects can be made without departing from the spirit and scope of the present disclosure, the inventive concepts reside in the claims hereinafter appended.

We claim:

1. A clothing accessory comprising:

a flat envelope formed from a first piece of fabric and a second piece of fabric mated to form the envelope, the envelope defining a generally rectangular shape with a first long edge and an opposing second long edge and a first short edge and an opposing second short edge, the first piece of fabric forming an outer side and the second piece of fabric forming an inner side, the second piece of fabric configured to interface with an edge of a clothing garment; and a first plurality of magnetic attachment structures provided between the first piece of fabric and the second piece of fabric and along the first long edge, the first plurality of magnetic attachment structures being magnetically attracted to a second plurality of magnetic attachment structures provided between the first and the second pieces of fabric and along the second long edge within the envelope, wherein the flat envelope is foldable around a folding line that longitudinally bisects the rectangular envelope, and when folded, the first plurality of magnetic attachment structures aligns with the second plurality of magnetic attachment structures thereby coupling the first plurality of magnetic attachment structures to the second plurality of magnetic attachment structures.

2. The clothing accessory of claim 1, wherein there is an interlining fabric positioned between the first piece of fabric and the second piece of fabric.

3. The clothing accessory of claim 1, wherein the first piece of fabric resembles fur.

4. The clothing accessory of claim 3, wherein the first piece of fabric has long and short sides that are greater in length than at least one of the interlining fabric and the second piece of fabric.

5. The clothing accessory of claim 1, wherein the envelope is sized and shaped to be attached to at least one of a clothing garment edge and a boot edge.

6. The clothing accessory of claim 5, wherein the clothing garment edge is defined by a hood of a coat.

7. A method of attaching a clothing accessory to an edge defined by a piece of clothing comprising:

providing a generally rectangular clothing accessory including:

a flat envelope formed from a first piece of fabric and a second piece of fabric mated to form the envelope, a first long edge and an opposing second long edge;

a first short edge and an opposing second short edge;

a plurality of magnetic attachment structures provided adjacent each of the opposing first and second long edges, the plurality of magnetic attachment structures provided between the first piece of fabric and the second piece of fabric, wherein the clothing accessory is foldable along a folding line that longitudinally bisects the clothing accessory;

positioning the first long edge of the clothing accessory adjacent a first side of the clothing edge;

folding the clothing accessory over the clothing edge about the folding line of the clothing accessory;

positioning the second long edge of the clothing accessory adjacent a second side of the clothing edge; and mating the plurality of magnetic attachment structures positioned at the first long edge with the plurality of magnetic attachment structures positioned at the second long edge.

8. The method of claim 7, wherein the clothing edge is a boot edge.

9. The method of claim 7, wherein the clothing edge is a collar.

10. The method of claim 7, wherein the clothing edge is a coat hood edge.

11. A clothing garment comprising:

a clothing edge defined by a first side and a second opposing side; and a removably attached clothing accessory including a flat envelope formed from a first piece of fabric and a second piece of fabric mated to form the envelope, the envelope defining a first long edge and an opposing second long edge and a first short edge and an opposing second short edge, wherein a plurality of magnetic attachment structures are provided adjacent each of the opposing first and second long edges of the clothing accessory between the first piece of fabric and the second piece of fabric, wherein the clothing accessory is foldable along a folding line that longitudinally bisects the clothing accessory, wherein the removably attached clothing accessory is folded along the folding line and attached to the clothing garment such that the first long edge of the clothing accessory is positioned adjacent the first side defining the clothing edge and the second long edge of the clothing accessory is positioned adjacent the second side defining the clothing edge with the plurality of magnetic attachment structures positioned at the first long edge mated with the plurality of magnetic attachment structures positioned at the second long edge to capture the clothing edge therebetween.

12. The clothing garment of claim 11, wherein the clothing edge is defined by a coat hood edge.

13. The clothing garment of claim 11, wherein the clothing edge is defined by a collar of the clothing garment.

14. The clothing garment of claim 11, wherein the clothing edge is defined by shoe wear.

* * * * *